US006804978B2

(12) United States Patent
Kost

(10) Patent No.: US 6,804,978 B2
(45) Date of Patent: Oct. 19, 2004

(54) KNITTED MESH FABRIC

(75) Inventor: David William Kost, Warwick (AU)

(73) Assignee: Gale Pacific Limited, Braeside (AU)

( * ) Notice: Subject to any disclaimer, the term of this patent is extended or adjusted under 35 U.S.C. 154(b) by 0 days.

(21) Appl. No.: 10/292,796

(22) Filed: Nov. 13, 2002

(65) Prior Publication Data

US 2003/0106347 A1 Jun. 12, 2003

(30) Foreign Application Priority Data

Nov. 14, 2001 (AU) ..... PR8863/01

(51) Int. Cl.[7] ..... D04B 21/00
(52) U.S. Cl. ..... 66/195
(58) Field of Search ..... 66/191, 192, 193, 66/194, 195, 196, 202; 442/312, 314, 306

(56) References Cited

U.S. PATENT DOCUMENTS 2,249,342 A * 7/1941 Aull ..... 66/195
2,411,175 A * 11/1946 Wagler ..... 66/193
4,015,451 A * 4/1977 Gajjar ..... 66/195
4,103,485 A * 8/1978 Brues ..... 66/192
4,748,078 A * 5/1988 Doi et al. ..... 442/312
5,732,573 A * 3/1998 Sexton ..... 66/195
6,276,178 B1 * 8/2001 West et al. ..... 66/193
6,446,472 B2 * 9/2002 West et al. ..... 66/193

* cited by examiner

*Primary Examiner*—Danny Worrell
(74) *Attorney, Agent, or Firm*—Lowe Hauptman Gilman & Berner LLP

(57) ABSTRACT

A knitted mesh fabric including an open framework of longitudinally and transversely extending knitted threads, and a plurality of resiliently, longitudinally extendible threads laid in the open framework in at least one direction. The open framework is contracted in the at least one direction when the resiliently extendible threads are in a relaxed or non-extended condition, whereby the open framework can be extended in the at least one direction causing the resiliently extendible threads to resiliently extend and the fabric to resiliently stretch.

29 Claims, 4 Drawing Sheets

KNITTED MESH FABRIC

BACKGROUND OF THE INVENTION

1. Field of the Invention

This invention relates to knitted mesh fabric and a process for knitting that fabric. The fabric is applicable for manufacturing a fleece retaining coat for fitting to a fleece bearing animal during biological shearing. It will be convenient to hereinafter disclose the invention in relation to that exemplary application, although it is to be appreciated that the invention is not limited thereto and may have a wide range of other applications such as wrapping or covering material and as a shade or protective canopy of a covering structure.

2. Description of the Prior Art

It is known to biologically "shear" sheep using a biological depilatory "defleecing" agent, such as epidermal growth factor. The defleecing agent causes a weakening or break in the wool staple at or near the skin surface, enabling the fleece to be easily removed.

Various coats have been proposed to be fitted to the sheep following administration of the defleecing agent so as to prevent uncontrolled removal and loss of the fleece. Australian patents 647084 and 655870, and applications 60853/73, 40926/96 and 65570/99 all disclose mesh or net fabric coats which are fitted to at least the body of the sheep so as to retain the fleece about the body as it separates from the skin. The mesh openings in the fabric are sized so as to retain the fleece but allow it to breath as well as enable moisture to escape from the coat.

A feature of these prior coats is that the mesh fabric has no more than a quite limited ability to stretch. That stretching is usually confined to the amount of localised "give" within stitches or connections between threads of the fabric. The dimensional stability of the fabric has been considered essential to prevent the fleece from moving on the sheep as it separates from the skin. The fleece is quite heavy, particularly when wet, and there have been concerns that the coat will stretch out of shape under weight of the separating fleece and the fleece will then collect under the neck and around the logs and belly of the sheep.

However, a problem with coats composed of fabric with limited stretch is that they will neatly fit only a very limited range of sheep. In particular, coats of a specific size tend to only properly fit one size sheep of a designated breed having a specified wool staple length. If the coat is over size then it will not support or retain the separating fleece in position on the sheep. Alternatively, if the coat is under size then it can be difficult to fit and will cause discomfort to the sheep, and can also make it difficult to separate the coat from the fleece when removed from the sheep.

This problem can be addressed by providing different sized coats to fit the various sizes of sheep within a flock. However, that increases the coat inventory required to be maintained by sheep shearers and owners. It will also complicate the procedures for coat fitting, adding to fitting time. These difficulties, in turn, can increase the cost of biologically shearing sheep.

SUMMARY OF THE INVENTION

It is an object of the present invention to provide a relatively simple knitted mesh fabric which has substantial resilient stretch qualities in at least one direction.

It is a further object to provide a knitted mesh fabric which has a degree of resilient stretch which makes it particularly suitable for use in the manufacture of fleece retaining coats for fitting to various sizes of fleece bearing animals.

It is another object to provide a knitted mesh fabric which has sufficient resilient stretch for use in the manufacture of fleece retaining coats for fitting to different breeds of fleece bearing animals.

With these objects in mind, the present invention in one aspect provides a knitted mesh fabric including:

an open framework of longitudinally and transversely extending knitted threads; and, a plurality of resiliently, longitudinally extendible threads laid in the open framework in at least one direction, the open framework being contracted in the at least one direction when the resiliently extendible threads are in a relaxed or non-extended condition, whereby the open framework can be extended in the at least one direction causing the resiliently extendible threads to resiliently extend and the fabric to resiliently stretch.

In another aspect of the present invention, there is provided a process for warp knitting a resiliently stretchable mesh fabric, including:

(a) feeding a plurality of warp threads to a warp knitting machine in accordance with a predetermined knit pattern;

(b) knitting the warp threads together in a predetermined knit pattern to form an open framework of longitudinally and transversely extending knitted threads;

(c) feeding a plurality of resiliently, longitudinally extendable threads to the warp knitting machine; and (d) laying the resiliently extendible threads in the open framework in at least one direction thereof during knitting of the open framework so that the open framework is contracted in the at least one direction when the extendible threads are in a relaxed or non-extended condition.

In a further aspect of the present invention, there is provided a product, such as a fleece retaining coat, manufactured from the above mesh fabric or using the above process.

It should be understood that the term "thread" as used herein includes mono- and multi-filament threads, and also two or more threads which are twisted or drawn together for knitting with other threads.

Preferably, the knitted threads form an array of thread connections extending in spaced apart rows along the longitudinally extending threads. The resiliently extendible threads are preferably laid in the longitudinal direction of the framework. In this way, the framework is contractible and extendible in the longitudinal direction.

Preferably, the resiliently extendible threads extend along the rows of thread connections. In one preferred arrangement, the resiliently extendible threads extend one each along each row of thread connections.

Preferably, the longitudinally extending threads are knitted into pillar stitches.

Preferably, the resiliently extendible threads are laid in some only of the pillar stitches. In one preferred arrangement the resiliently extendible threads are laid in the pillar stitches in a regularly repeating sequence. In one form, the resiliently extendible threads weave between opposite sides of respective rows of thread connections, through the pillar stitches, and along the rows of thread connections.

In one preferred arrangement, the resiliently extendible threads are laid in without locking stitches.

In an alternative preferred arrangement, the resiliently extendible threads are laid in with locking stitches so as to lock the resiliently extendible threads into the framework. The locking stitches are preferably knitted with some of the pillar stitches. In one form, each resiliently extendible thread has at least one locking stitch in each repeat of the knit pattern of the open framework.

Preferably, each resiliently extendible thread has a core filament of rubber and an outer cover of yarn spiral wrapped about the core filament.

Preferably, the longitudinally extending threads are knitted in spaced apart rows, and the rows of threads adopt a zigzag configuration generally in the plane of the open framework when the framework is contracted.

In a further aspect of the present invention, there is provided a knitted mesh fabric, comprising an open, generally planar framework of knitted inelastic threads including rows of spaced apart, knitted threads; and a plurality of elastic threads laid along the rows of threads, and weaving between opposite sides of respective inelastic thread rows. The open framework is contracted when the elastic threads are in a unstretched condition. The threads of the framework remain generally in the plane of the contracted framework and the rows of threads fold in a zigzag configuration into spaces between the rows so as to partially close the spaces, whereby extending the contracted framework in a direction of the rows causes the elastic threads to resiliently stretch and the rows of inelastic threads to unfold so as to open the spaces.

DESCRIPTION OF THE DRAWINGS

The following description refers to preferred embodiments of the knitted fabric of the present invention as well as a process for knitting that fabric. To facilitate an understanding of the invention, reference is made in the description to the accompanying drawings where the knitted fabric of those embodiments is illustrated. It is to be understood that the knitted fabric is not limited to the preferred embodiments as hereinafter described and as illustrated in the drawings.

In the drawings, where the same reference numerals identify the same or similar components.

DETAILED DESCRIPTION OF PREFERRED EMBODIMENTS OF THE INVENTION

Figure 1:
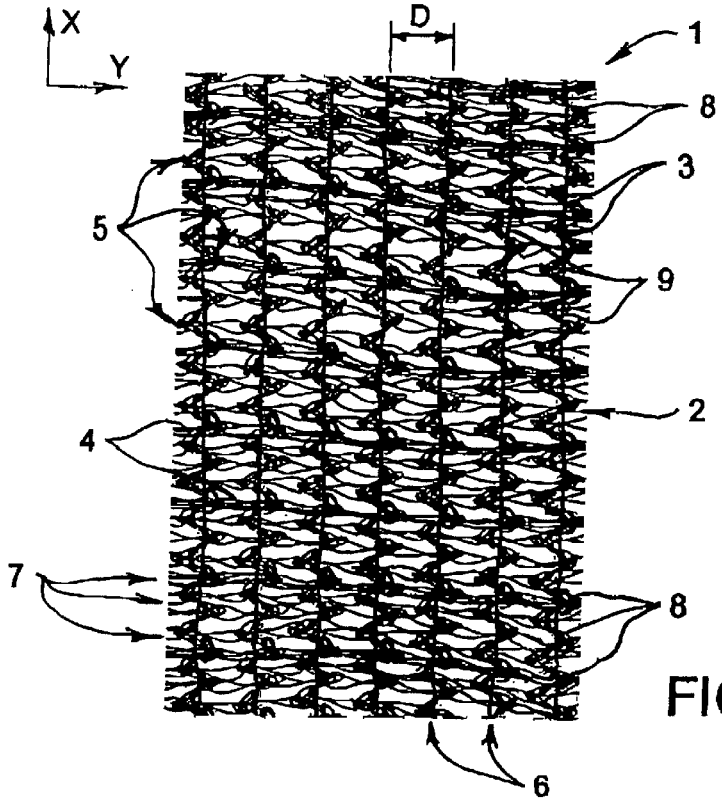
FIG. 1 is a plan view of an unstretched piece of warp knitted mesh fabric according to one preferred embodiment of the present invention.
Figure 2:
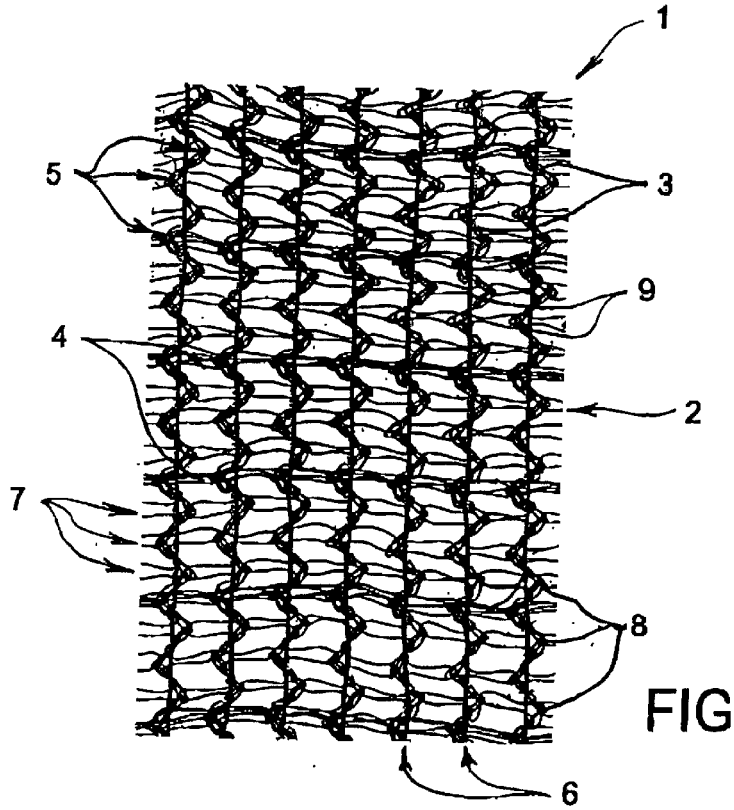
FIG. 2 is a plan view of the piece of mesh fabric of FIG. 1 when stretched in the longitudinal direction.
Figure 3:
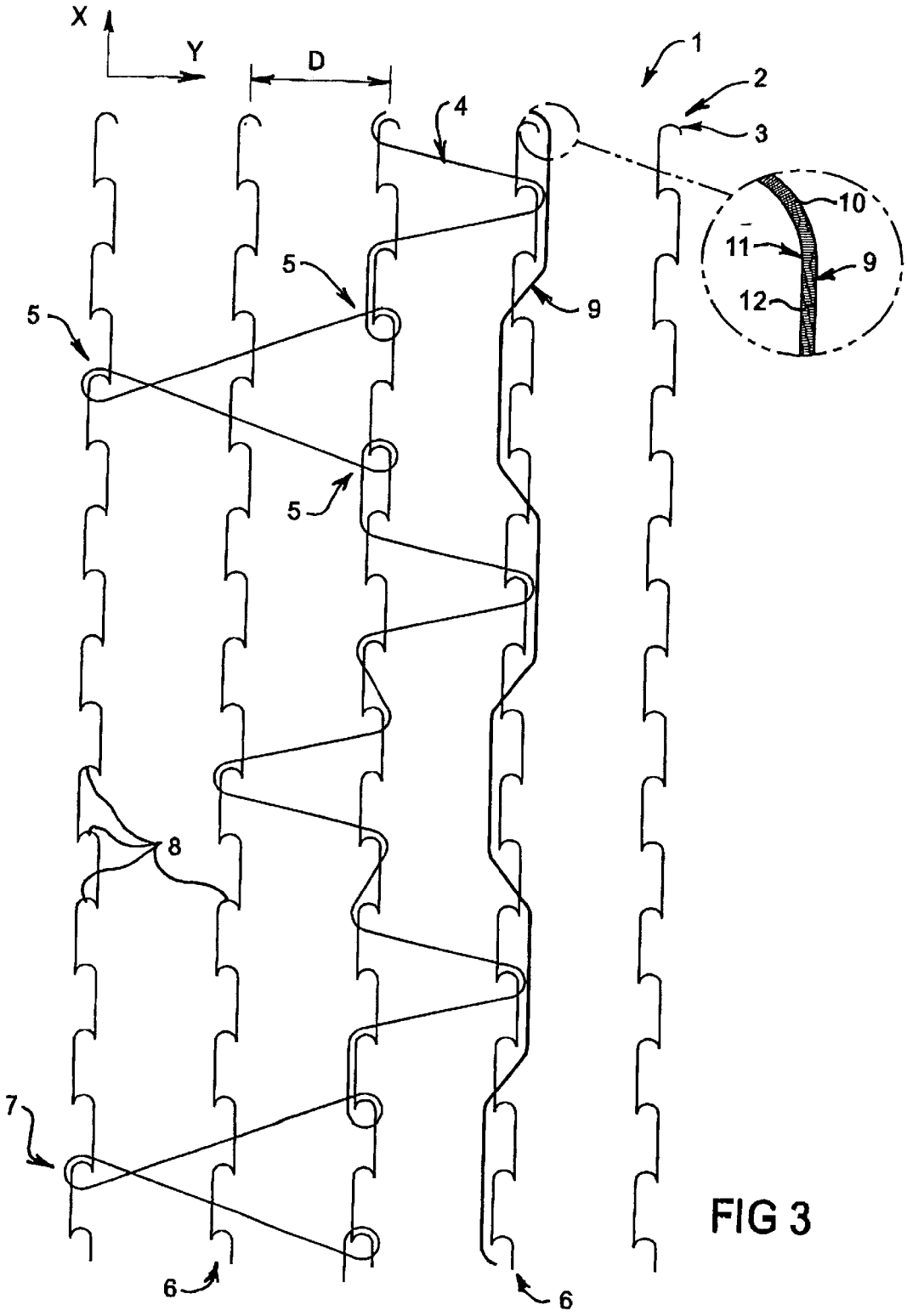
FIG. 3 is an enlarged scale and simplified view of a section of the mesh fabric piece of FIG. 1 showing the thread knit pattern.

Referring initially to FIGS. 1 to 3 of the drawings, there is generally shown a piece of warp knitted fabric 1 according to one preferred embodiment of the present invention. The fabric 1 has an open framework 2 in the nature of mesh or net formed of a plurality of threads 3,4 knitted together in a predetermined knit pattern. The individual threads 3,4 are best shown in FIG. 3, whilst the knit pattern of those threads 3,4 and the mesh or net nature of the fabric 1 are best shown in FIGS. 1 and 2.

The longitudinally and transversely extending threads 3,4 are knitted together to form an array of thread connections 5. Those thread connections 5 extend in spaced apart rows 6 along the fabric 1, and in courses 7 across the fabric 1, having regard to the direction of knit of the framework 2. The threads 4 extend on at least some of the courses 7 between adjacent thread connections 5. The threads 3 extend generally in a longitudinal direction of knit X of the fabric 1 along the rows 6, whilst the threads 4 extend generally in a transverse direction Y of the fabric 1 between the rows 6. Each thread 3 extends along a respective row 6, whilst each thread 4 is knitted primarily with thread 3 in one row 6 but also intermittently with threads 3 in adjacent rows 6.

It will be appreciated that FIG. 3 shows a section of the fabric 1 which has been simplified so as to more clearly depict the thread layout. In particular, one only transversely extending thread 4 is shown knitted with a group of adjacent longitudinally extending threads 3. In the actual framework 2, the transversely extending threads 4 are knitted one each primarily with a thread 3 in a respective row 6 and intermittently with threads 3 in adjacent rows 6 in accordance with the layout shown in FIG. 3.

The rows of thread connections 5 are provided by knitting the threads 3 into pillar stitches 8, with the threads 4 extending between adjacent rows 6 being thread underlaps.

The rows 6 of thread connections 5 are spaced apart a distance D selected depending on the intended application of the fabric 1. In the exemplary application, that spacing distance D can be nominally from about 10 mm when the fabric framework 2 is contracted. In the illustrated embodiment, the spacing distance D is about 15 mm when the fabric framework 2 is contracted.

The longitudinally and transversely extending threads 3,4 are knitted together using a multi-bar warp knitting machine (not shown). The longitudinally extending threads 3 are fed to the first or front bar, and the transversely extending threads 4 are fed to at least one successive bar, in a manner well understood by those skilled in the relevant knitting art. The threads 3 fed to the first or front bar form the pillar stitches 8, whilst the threads 4 fed to the successive bar(s) are knitted with those pillar stitches 8 at some connections 5 and are laid in the pillar stitches 8 at other connections 5.

This knitting pattern produces a framework 2 in which the threads 3,4 are locked into each other and so will resist laddering or fraying if the fabric 1 is snagged or cut. That ability provides particular advantages in the exemplary application of the fabric 1, where cutting of the fabric 1 is required during manufacture of the fleece retaining coat, and the coat fabric 1 can be prone to snagging once fitted to sheep.

Laying in the transversely extending threads 4 (rather than knitting them with threads 3) at some connections 5 facilitates controlled contraction of the framework 2. In particular, as shown in FIG. 1 and as will become more apparent hereinafter, the rows 6 of thread connections 5 or pillar stitches 8, are caused to longitudinally contract in a zigzag configuration within the general plane of the mesh fabric 1. That contraction in turn, avoids "bubbling" or "puckering" of the framework 2 out of the fabric plane, thus making the framework 2 less prone to snagging at least in the exemplary application of the fabric 1.

Each longitudinally and transversely extending thread 3,4 is a monofilament, although it will be appreciated that two or more filaments may be twisted or drawn together in order to from each thread 3,4.

The threads 3,4 are composed of any material suitable to the intended application of the fabric 1. In the exemplary application, the threads 3,4 are composed of plastic filament. The plastic material is heat shrinkable to enable thermo-mechanical fixing of the fabric 1, as will be well understood by those skilled in the relevant art. Moreover, the plastic material exhibits properties, such as being inert to the fleece and ultraviolet light stabilised, to achieve acceptable performance in the exemplary application.

The fabric 1 also includes a plurality of resiliently, longitudinally extendible threads 9 laid in the fabric framework 2. The threads 9 are laid in the longitudinal direction X of the fabric framework 2 so that the fabric 1 contracts, and is stretchable, in that longitudinal direction X. The fabric 1 is generally resistant to extension or stretch in the transverse direction Y.

The extendible threads 9 are arranged in parallel, spaced apart rows in the longitudinal direction X. The threads 9 will typically extend continuously in rows along the framework 2, although depending on the intended application at least some of the threads 9 may extend intermittently along those rows.

In this preferred embodiment, the extendible threads 9 are laid along the rows 6 of thread connections 5. Thus, the threads 9 are laid in the pillar stitches 8. The extendible threads 9 may be laid along each thread connection row 6, or along only some of those rows 6, depending on the intended application of the fabric 1. In the exemplary application and as shown, the extendible threads 9 are laid along each thread connection row 6.

The extendible threads 9 extend along the rows of thread connections and are intermittently laid in the pillar stitches 8. That is, the extendible threads 9 are laid in some but not each pillar stitch 8. In this embodiment, the extendible threads 9 are laid in the pillar stitches 8 in a regularly repeating sequence. As shown, the extendible threads 9 are laid in about every third pillar stitch 8, although it will be appreciated that the spacing between each lay in may vary with the intended application of the fabric 1.

When the fabric 1 is knitted using a multi-bar warp knitting machine, then the extendible threads 9 are fed to a back bar. That back bar moves from side to side of the rows 6 of thread connections 5 so that the extendible threads 9 "weave" along and are intermittently laid in through the pillar stitches 8 of respective rows 6 of thread connections 5. In this embodiment, the extendible threads 9 also lay between the loop and underlap of the other threads 3,4 to avoid being knitted or locked into the connections 5 of the other threads 3,4.

The extent of stretching of the fabric 1 can vary depending on its intended application, and will be controlled by the extendible threads 9. In one preferred embodiment of the fabric 1 suitable for the exemplary application, the extendible threads 9 permit resilient stretching of the fabric 1 in the longitudinal direction X of up to about 3 times its contracted dimension. That stretch is typically between about 2 and 3 times the contracted dimension of the fabric 1.

The extendible threads 9 are composed of any material suitable to the intended application of the fabric 1. In the exemplary application, those threads 9 include filaments 10 of natural or synthetic rubber. Each thread 9 may have a monofilament, or two or more filaments 10 may act together to form each thread 9.

In order for the extendible threads 9 to contract the fabric framework 2 following fabric stretching, the extendible threads 9 should resist movement relative to the framework threads 3,4 in which they are laid during that stretching. In particular, during fabric stretching, the extendible threads 9 should not slide along the rows 6 of thread connections 5 or pillar stitches 8, otherwise when the extendible threads 9 retract the framework 2 will not contract along with those threads 9.

In one embodiment (not shown) of the present invention, the rubber filaments 10 themselves may frictionally engage the framework threads 3,4 sufficiently to resist that relative sliding movement. However, in an alternative embodiment (as shown), the extendible threads 9 include means which grip or engage the framework threads to enhance that resistance to slippage.

In that alternative embodiment, the gripping or engaging means 11 provides for frictional grip or engagement between the extendible threads 9 and the framework threads 3,4. That grip or engagement means 11 includes a slip resistant coating or cover on the extendible filaments 10 which then form a core to the extendible threads 9. As shown, the gripping or engaging means 11 is a cover formed of a yarn 12 spiral wrapped about the filaments 10. The yarn is a multi-filament nylon yarn 12. The cover also acts to restrict the amount to which the core filaments 20 can extend.

Figure 4:
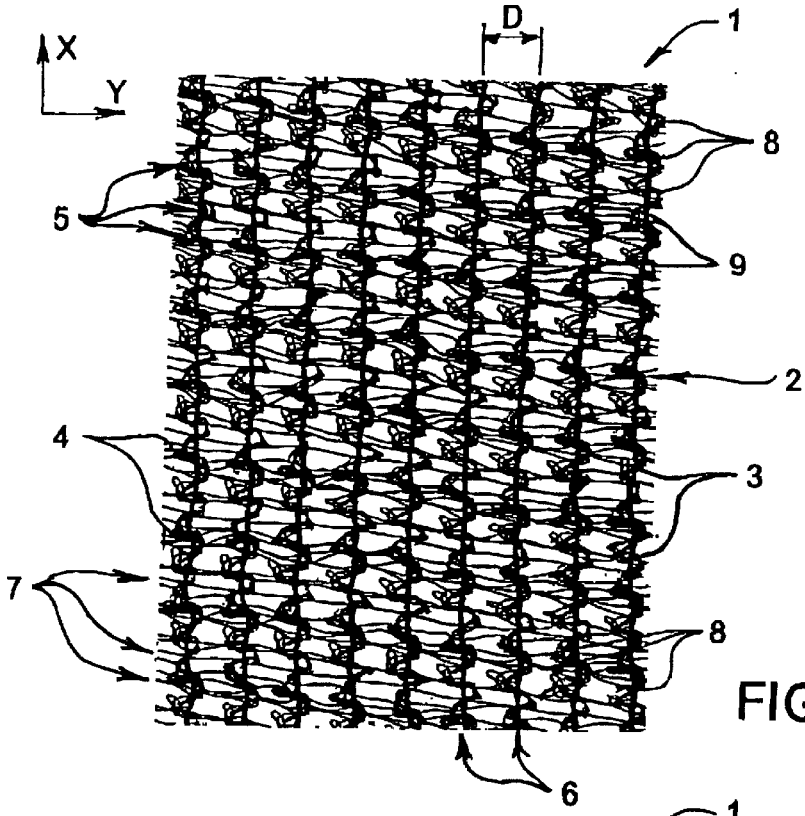
FIG. 4 is a plan view of an unstretched piece of warp knitted mesh fabric according to another preferred embodiment of the present invention.
Figure 5:
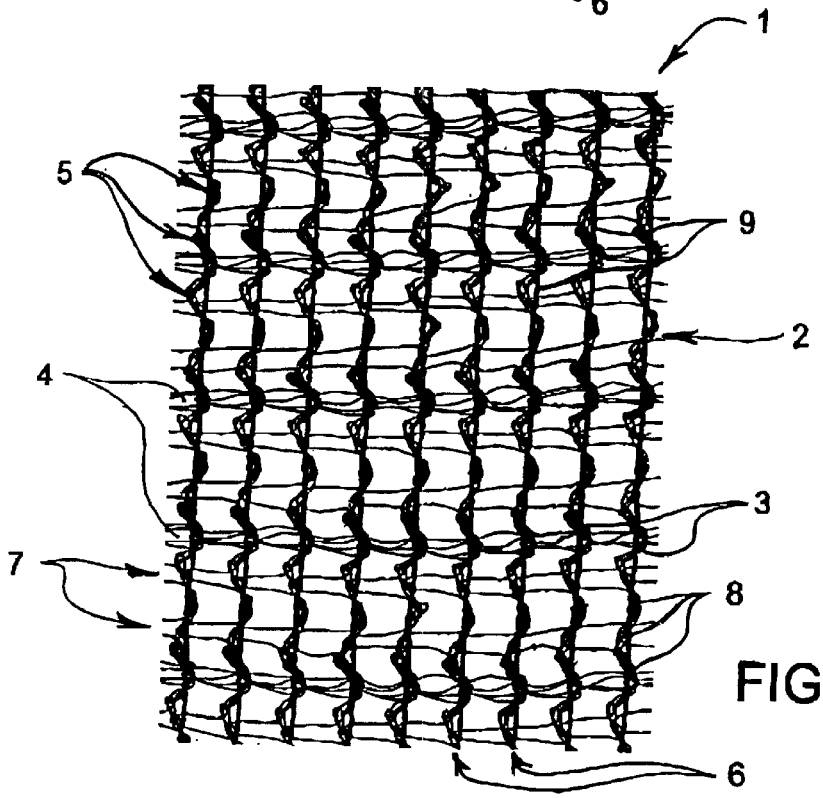
FIG. 5 is plan view of the piece of mesh fabric of FIG. 4 when stretched in the longitudinal direction; and, FIG. 6 is an enlarged scale and simplified view of a section of the mesh fabric piece of FIG. 4 showing the thread knit pattern.
Figure 6:
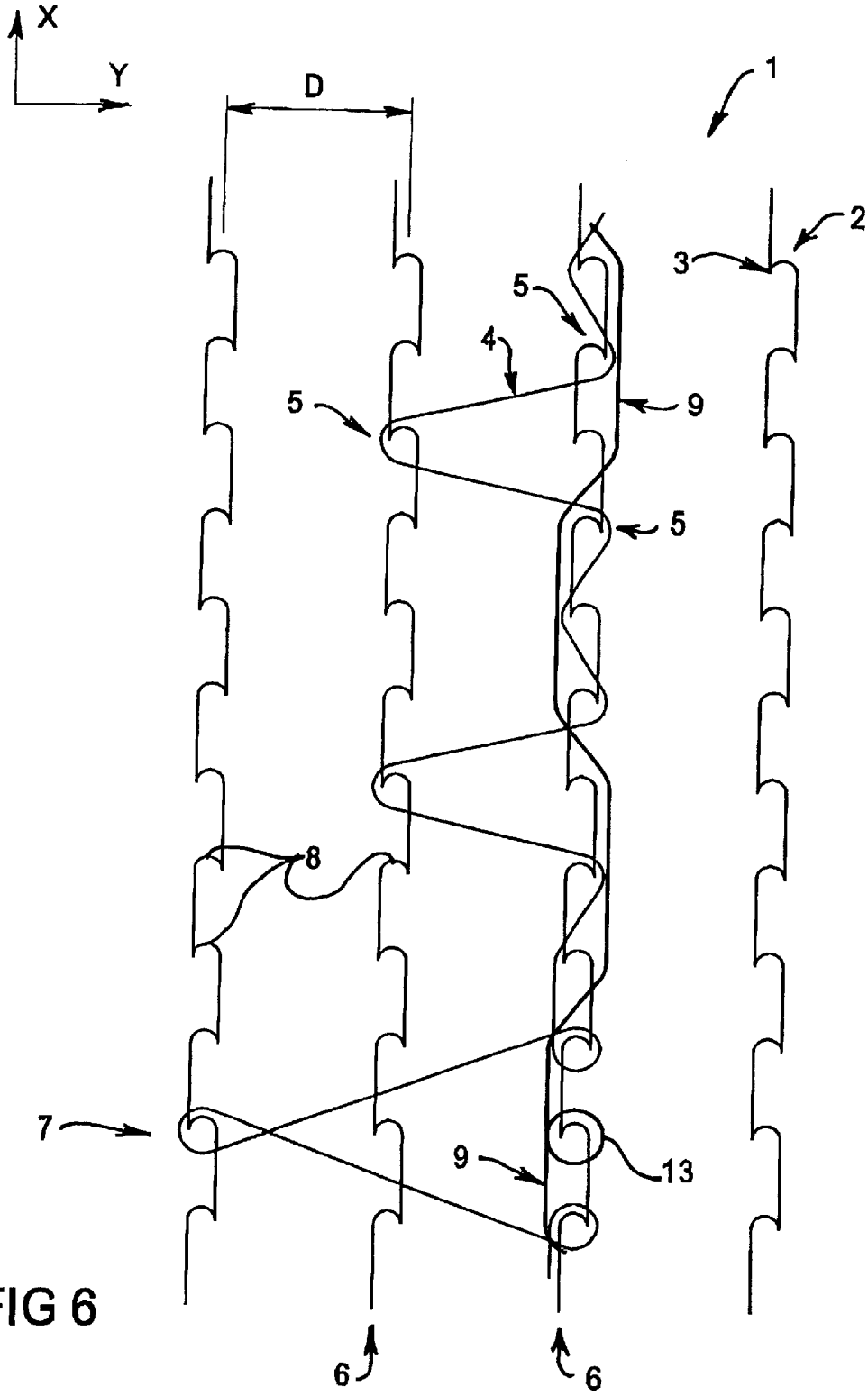

Referring now to FIGS. 4 to 6, there is generally shown a piece of warp knitted fabric 1 according to another preferred embodiment of the present invention. FIGS. 4 to 6 correspond to FIGS. 1 to 3, respectively and show a similar fabric 1.

However, in this fabric embodiment the transversely extending threads 4 have a different knit pattern as is evident by comparing FIGS. 3 and 6. That results in a framework 2 of a different pattern.

In addition, the resiliently extendible threads 9 are laid in with locking stitches 13 knitted with some of the pillar stitches 8. Those locking stitches 13 further secure the threads 9 into the framework 2 against relative-sliding that would cause the threads 9 to retract along the rows 6 of thread connections 5 upon stretching of the fabric 1.

Each locking stitch 13 is formed by a loop in the thread 9. The stitches 13 are formed intermittently or occasionally along the rows 6 of thread connections 5. That is, the locking stitches 13 occur at some but not each occurrence that the threads 9 are laid into the thread connections 5. In the embodiment shown, each thread 9 has one locking stitch 13 in each repeat of the knit pattern of the framework 2. It will be appreciated that more than one locking stitch 13 may be provided in each knit pattern repeat.

The mesh fabric of the present invention is resiliently stretchable to a substantial extent in one direction. Moreover, the fabric is resistant to bubbling or puckering, thereby retaining its generally planar shape when in its unstretched condition.

The mesh fabric is particularly suitable for applications where the fabric is required to stretch to fit different circumstances, but nevertheless retain its general configuration and functional characteristics. One such application is in fleece retaining coats where coats manufactured from the fabric can be stretched to fit sheep of different sizes or breeds or with different wool staple lengths, but still function satisfactorily to retain the separating fleece on the sheep.

In that application, the coats can be easily cut from the fabric using a hot knife thereby sealing the ends of the threads forming the coat. The coats will usually be cut from the fabric so that the stretch in the coat is about, rather than along, the animal.

The use of the fabric in that application will simplify coat inventories and fitting to sheep, leading to economic advantages in sheep shearing.

Finally, it is to be understood that various alterations, modifications and/or additions may be made to the fabric without departing from the ambit of the present invention as defined in the claims appended hereto.

What is claimed is:

1. A knitted mesh fabric, comprising:

a plurality of longitudinally and transversely extending knitted threads forming an open, generally planar framework with spaces defined between the threads; and a plurality of resiliently, longitudinally extendible threads laid in the open framework in at least one direction;

the open framework being contracted in the at least one direction when the resiliently extendible threads are in a relaxed or non-extended condition, wherein the threads of the framework remain generally in the plane of the contracted framework and contract into the spaces so as to partially close the spaces, whereby the fabric is stretchable in the at least one direction causing the resiliently extendible threads to resiliently extend and the framework to extend so as to open the spaces between the threads of the framework.

2. A fabric as claimed in claim 1, wherein the knitted threads form an array of thread connections extending in spaced apart rows along the longitudinally extending threads and the resiliently extendible threads are laid in the longitudinal direction of the framework thereby enabling longitudinal contraction and extension of the framework.

3. A fabric as claimed in claim 2, wherein the resiliently extendible threads extend along the rows of thread connections.

4. A fabric as claimed in claim 2, wherein the resiliently extendible threads extend one each along each row of thread connections.

5. A fabric as claimed in claim 1, wherein the longitudinally extending knifed into pillar stitches.

6. A fabric as claimed in claim 5, wherein the resiliently extendible threads are laid in some only of the pillar stitches.

7. A fabric as claimed in claim 6, wherein the resiliently extendible threads are laid in the pillar stitches in a regularly repeating sequence.

8. A fabric as claimed in claim 6, wherein the resiliently extendible threads weave between opposite sides of respective rows of thread connections, through the pillar stitches, and along the rows of thread connections.

9. A fabric as claimed in claim 1, wherein the resiliently extendible threads are laid in without locking stitches.

10. A fabric as claimed in claim 1, wherein the resiliently extendible threads are laid in with locking stitches so as to lock the resiliently extendible threads into the framework.

11. A fabric as claimed in claim 10, wherein the longitudinally extending threads are knitted into pillar stitches, and the locking stitches are knitted with some of the pillar stitches.

12. A fabric as claimed in claim 11, wherein each resiliently extendible thread has at least one locking stitch in each repeat of the knit pattern of the open framework.

13. A fabric as claimed in claim 1, wherein each resiliently extendible thread has a core filament of rubber and an outer cover of yarn spiral wrapped about the core filament.

14. A fabric as claimed in claim 5, wherein the transversely extending threads extend between the rows of thread connections, and are knitted with at least some of the pillar stitches.

15. A fabric as claimed in claim 14, wherein the transversely extending threads are laid in but not knitted with at least some of the pillar stitches.

16. A process of warp knitting a resiliently stretchable mesh fabric, said method comprising:

(a) feeding a plurality of warp threads to a warp knitting machine in accordance with a predetermined knit pattern;

(b) knifing the warp threads together in a predetermined knit pattern to form an open, generally planar framework of longitudinally and transversely extending knitted threads defining spaces between the threads;

(c) feeding a plurality of resiliently, longitudinally extendible threads to the warp knitting machine; and (d) laying the resiliently extendible threads in the open, generally planar framework in at least one direction thereof during said knitting of the open framework so that the open framework is contracted in the at least one direction when the extendible threads are in a relaxed or non-extended condition, wherein the threads of the framework are generally in the plane of the open framework and contract into the spaces so as to partially close the spaces in the contracted framework.

17. A process as claimed in claim 16, wherein said knitting the warp threads together includes forming an array of thread connections extending in spaced apart rows along the longitudinally extending threads, and the resiliently extendible threads are laid in the longitudinal direction of the open framework.

18. A process as claimed in claim 17, wherein said laying in the resiliently extendible threads includes extending the resiliently extendible threads along the rows of thread connections.

19. A process as claimed in claim 17, wherein knitting the rows of thread connections includes knitting the longitudinally extending threads into pillar stitches.

20. A process as claimed in claim 19, wherein said laying in the resiliently extendible threads includes laying the resiliently extendible threads in some only of the pillar stitches of the rows of thread connections.

21. A process as claimed in claim 20, wherein said laying in the resiliently extendible threads includes weaving the resiliently extendible threads along between opposite sides of respective rows of thread connections through the pillar stitches, and along the rows of thread connections.

22. A process as claimed in claim 16, wherein the resiliently extendible threads are laid in without locking stitches.

23. A process as claimed in claim 16, wherein the resiliently extendible threads are laid in with locking stitches so as to lock the resiliently extendible threads into the open framework.

24. A process as claimed in claim 23, wherein said knitting the rows of thread connections includes knitting the longitudinally extending threads into pillar stitches; and the locking stitches are knitted with some of the pillar stitches.

25. A process as claimed in claim 24, wherein each resiliently extendible thread has at least one locking stitch in each repeat of the predetermined knit pattern of the open framework.

26. A process as claimed in claim 19, wherein the transversely extending threads extend between the rows of thread connections, and are knitted with at least some of the pillar stitches.

27. A process as claimed in claim 26, wherein the transversely extending threads are laid in but not knitted with at least some of the pillar stitches.

28. A fabric as claimed in claim 1, wherein the longitudinally extending threads are knitted in spaced apart rows, and the rows of threads adopt a zigzag configuration generally in the plane of the open framework when the framework is contracted.

29. A knifed mesh fabric, comprising:

an open, generally planar framework of knitted inelastic threads including rows of spaced apart, knitted threads; and a plurality of elastic threads laid along the rows of threads, and weaving between opposite sides of respective inelastic thread rows;

the open framework being contracted when the elastic threads are in a unstretched condition, the threads of the framework remaining generally in the plane of the contracted framework and the rows of threads folding in a zigzag configuration into spaces between the rows so as to partially close the spaces, whereby extending the contracted framework in a direction of the rows causes the elastic threads to resiliently stretch and the rows of inelastic threads to unfold so as to open the spaces.

* * * * *